US009513007B2

(12) United States Patent
Kuchta

(10) Patent No.: US 9,513,007 B2
(45) Date of Patent: Dec. 6, 2016

(54) ELECTRICAL ISOLATION DEVICE

(71) Applicant: Ben Kuchta, Nuneaton (GB)

(72) Inventor: Ben Kuchta, Nuneaton (GB)

( * ) Notice: Subject to any disclaimer, the term of this patent is extended or adjusted under 35 U.S.C. 154(b) by 0 days.

(21) Appl. No.: 14/471,518

(22) Filed: Aug. 28, 2014

(65) Prior Publication Data

US 2015/0061861 A1 Mar. 5, 2015

(30) Foreign Application Priority Data

Aug. 29, 2013 (GB) ..... 1315358.0

(51) Int. Cl.

| | |
|---|---|
| ***G08B 17/00*** | (2006.01) |
| ***F23N 5/16*** | (2006.01) |
| ***A62C 3/00*** | (2006.01) |
| ***G08B 1/08*** | (2006.01) |
| ***A62C 37/36*** | (2006.01) |
| ***F23N 5/24*** | (2006.01) |
| *A62C 3/06* | (2006.01) |

(52) U.S. Cl.

CPC ..... *F23N 5/16* (2013.01); *A62C 3/006* (2013.01); *A62C 37/36* (2013.01); *F23N 5/242* (2013.01); *G08B 1/08* (2013.01); *A62C 3/06* (2013.01)

(58) Field of Classification Search

CPC ..... F23N 5/26; F23N 5/16; A62C 3/06; A62C 37/36; A62C 37/38; G08B 1/08; G08B 17/00; G08B 17/10; G08B 21/00

USPC ..... 340/506, 531, 577, 584, 628, 630, 632,340/532, 538.12; 73/24.01, 24.02

See application file for complete search history.

(56) References Cited

U.S. PATENT DOCUMENTS

| | | | | |
|---|---|---|---|---|
| 4,390,785 | A * | 6/1983 | Faulhaber | G01J 5/60 250/330 |
| 4,602,357 | A * | 7/1986 | Yang | G08B 25/016 340/13.28 |
| 4,617,555 | A | 10/1986 | Sheiman | |
| 4,881,058 | A * | 11/1989 | Berry, III | G08B 27/00 340/326 |
| 5,508,568 | A | 4/1996 | Mammen | |
| 5,596,146 | A * | 1/1997 | Waller | G01N 21/1702 356/432 |

(Continued)

FOREIGN PATENT DOCUMENTS

WO WO2007122296 A1 11/2007

OTHER PUBLICATIONS

GB1315358.0 Search Report filed Aug. 29, 2013.

*Primary Examiner* — Hung T Nguyen
(74) *Attorney, Agent, or Firm* — Notaro, Michalos & Zaccaria P.C.

(57) ABSTRACT

An isolation device is fitted to a mains electrical supply for a hydrocarbon burning appliance and is adapted to operate in response to an audible alarm signal emitted by a separately located detector, typically a carbon monoxide detector, to disconnect the power supply and thereby shutdown the operation of the hydrocarbon burning appliance. This can halt a potentially dangerous build up of CO in the vicinity of the appliance. The device includes a microphone circuit, a lock-in amplifier operable to lock on to a potential alarm signal within the audio signals detected by the microphone circuit, a processing unit operable to monitor the output of the lock-in amplifier so as to compare the potential alarm signal to a stored reference to determine whether it is an alarm signal and a relay operable in response to disconnect the electrical supply of the hydrocarbon burning apparatus.

20 Claims, 2 Drawing Sheets

(56) References Cited

U.S. PATENT DOCUMENTS

Figure 1:
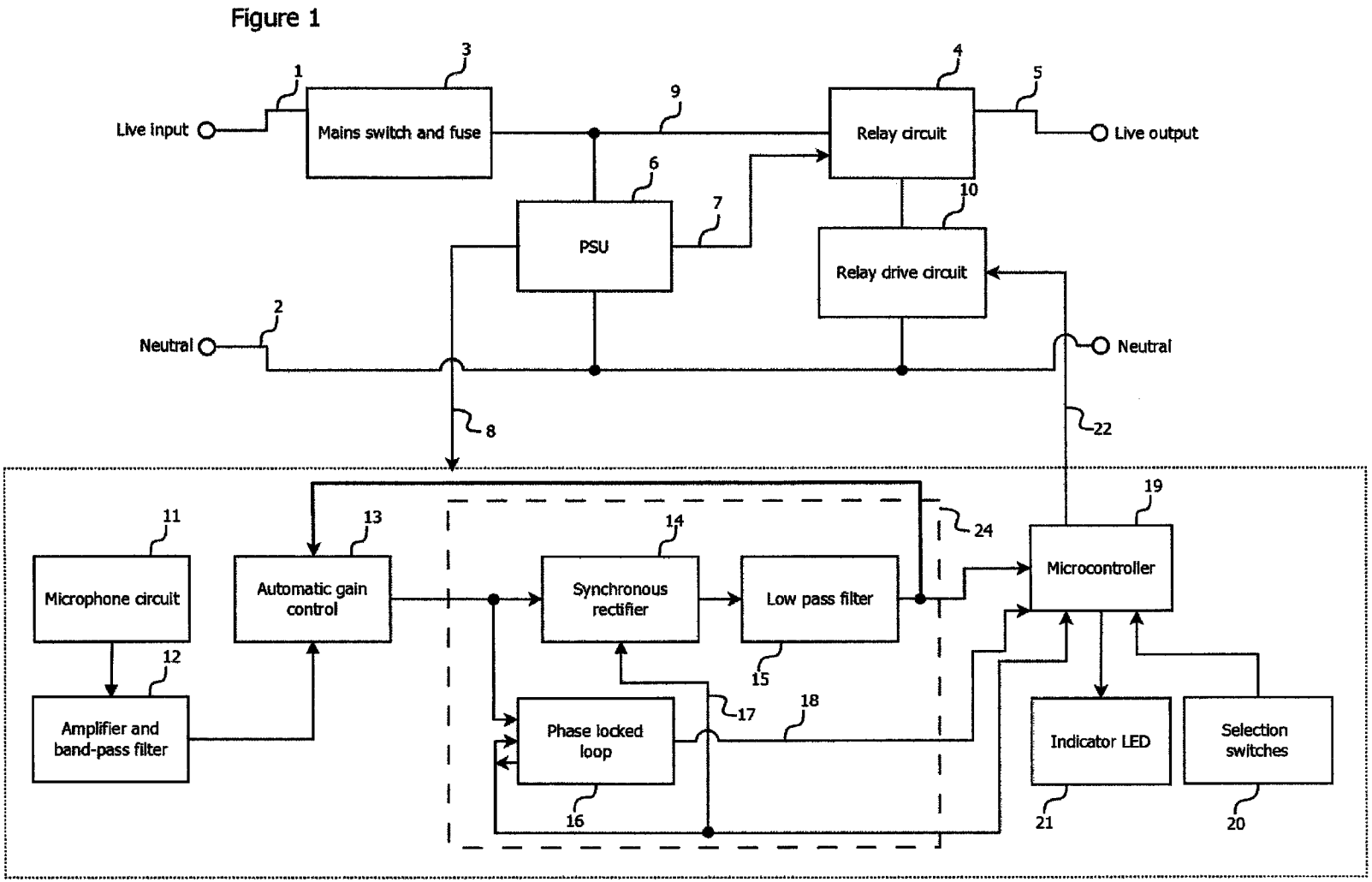

| | | | | |
|---|---|---|---|---|
| 5,729,145 | A * | 3/1998 | Blades | G01R 31/1272 324/522 |
| 5,966,076 | A * | 10/1999 | Cantrell | G01M 3/18 137/247.15 |
| 8,334,785 | B1 * | 12/2012 | Zetts | G08B 7/064 340/309.16 |
| 2006/0044133 | A1 | 3/2006 | Lou | |
| 2008/0180261 | A1 * | 7/2008 | Shirlee | G08B 17/10 340/632 |
| 2009/0029414 | A1 | 1/2009 | Swartz | |
| 2010/0302045 | A1 * | 12/2010 | Foster | G08B 17/00 340/577 |

* cited by examiner

ELECTRICAL ISOLATION DEVICE

TECHNICAL FIELD OF THE INVENTION

The present invention relates to an electrical isolation device and in particular to an electrical isolation device operable to disconnect power to an electrically controlled hydrocarbon fuel burning appliance in response to the activation of an alarm produced by a carbon monoxide (CO) detector.

BACKGROUND TO THE INVENTION

Common hydrocarbon fuel burning appliances use natural gas (NG) or liquid petroleum gas (LPG) or heavy oil (HO) for heating and normally use electrical power for control and indication. When faulty, or inadequately ventilated, operation of such appliances can result in the emission of carbon monoxide (CO) gas. As CO is colourless, odourless and tasteless, it is advisable to mount domestic CO detectors at ceiling level, away from dead spaces or obstructions for the effective detection of less dense CO gas. However a compromise is normally made between the CO detectors being sited near potential sources of CO gas and the alarm being loud enough to be heard throughout the building. Such detectors are mainly battery powered, enabling a simple low cost installation and usually do not require battery replacement during the detectors operation life.

When an integrated response level is exceeded, the CO detector is operable to output an audio alarm signal, which at best would result in the manual isolation of power to an electrically controlled appliance, which is likely to expose the responsible person to a greater level of CO gas. This can result in dizziness, confusion, unconsciousness, brain damage and ultimately death.

If no manual isolation of power to the appliance is achieved, the alarm will continue to sound until the battery is exhausted or the detector reaches the end of a predetermined alarm cycle. During this time, the appliance may continue to operate and raise the concentration of CO levels. This may occur if the building is unoccupied, if the alarm is insufficiently audible or if the occupants are heavy sleepers, intoxicated, have a hearing impairment, infirm or infant. It is therefore desirable to provide an automated isolation device operable to the safe disconnection of power to an electrically controlled appliance in response to the activation of an alarm produced by a carbon monoxide (CO) detector.

In this context, WO 2010/136808 discloses a device for detecting and responding to an audio alarm from a smoke detector. The device detects audio signals, processes the audio signals and thus identifies audio alarm signals. In order to avoid false alarms, there is a need to discriminate between alarm signals and other noise signals, for example from a TV, radio or other unrelated alarms. In this case, discrimination is made by filtering the detected signal, the pass band of the filter centred on the alarm frequency. However, a compromise is made in the frequency discrimination to accommodate the wide variations in the alarm signal frequency. This is mainly due to the initial accuracy of the piezoelectric sounder used in the detector and the associated frequency drift with temperature and age. Typically the input filter needs to have a pass-band of at least 3.2 KHz+/−500 Hz or a bandwidth of a minimum of 1 KHz, giving a very low Q of about 3. Given that significant levels of audio noise could exist near to the pass-band, or even in the pass-band, a large processing delay may be required to reject a false alarm, which can make a test of the system impractical. It is also possible that a real alarm signal may actually be at a similar or even lower level than a noise source, causing the alarm signal to be masked by the noise and to remain undetected. In view of the above the device of WO 2010/136808 is unreliable in practice.

An alternative device is disclosed in WO2011/014694 providing an improvement to the detection signal to noise ratio, by using many selective filters, to cover the same pass-band. Assuming each filter had an individual pass-band of +/−25 Hz, then an impractical 20 high Q filters would be required to cover the expected frequency range. Furthermore the device will need to undertake complex analysis to monitor all the outputs of each filter. As such, this arrangement is relatively complex, expensive and impractical.

It is therefore an object of the present invention to provide an isolation device that at least partially overcomes or alleviates some of the above problems.

SUMMARY OF THE INVENTION

According to a first aspect of the present invention there is provided an electrical isolation device suitable for isolating the electrical supply of a fuel burning appliance in response to an audio alarm, the device comprising: a microphone circuit operable to detect audio signals; a lock-in amplifier connected to the output of the microphone circuit and operable to lock on to the alarm frequency and recover the modulated signal pattern of a potential alarm within the audio signals detected by the microphone circuit; a processing unit operable to monitor the output of the lock-in amplifier for valid output signals so as to compare the potential alarm signal to a stored reference to determine whether it is an alarm signal and output an alarm indication in response thereto; and a switch operable in response to said alarm indication to disconnect the electrical supply of the fuel burning apparatus.

By using a lock-in amplifier on a potential alarm signal, such alarm signals can be readily detected and isolated over a relatively wide frequency range with relatively low demands on processing power. This can thus provide for relatively cheap, safe, reliable and robust detection even in high levels of ambient audio noise.

The fuel burning appliance may be a hydrocarbon fuel burning appliance. The alarm signal may be an alarm signal output by a carbon monoxide (CO) alarm unit.

The device may comprise an amplifier and band pass filter to provide in-band gain to the output of the microphone circuit before input to the lock-in amplifier. The band pass filter may be a low Q filter. The band pass filter may be adapted to have a pass band centred on the expected alarm frequency. The bandwidth of the input filter may be sufficient to pass the expected alarm frequency, allowing for drift due to temperature and or age of the sounder.

An automatic gain control may be provided to maintain the signal output level from the amplifier and band pass filter before input to the lock-in amplifier.

Within the lock-in amplifier the input signal may be demodulated by a demodulation arrangement. The demodulation arrangement may comprise a synchronous-rectifier in combination with a phase lock loop (PLL) wherein the PLL is operable to control the polarity of the gain of the synchronous-rectifier. In particular, the synchronous rectifier may be controlled in response to the voltage controlled oscillator (VCO) output of the PLL. The demodulation arrangement may also comprise a low pass filter. The low pass filter may comprise an RC filter with a time constant greater than the period of one cycle of the alarm frequency and less than the minimum temporal envelope period of the modulated alarm signal.

The processing unit may be used to receive the output of the demodulation arrangement. The processing unit may be operable to maintain a count of VCO pulses on each burst, when a lock signal is also applied by the PLL. The VCO count may be monitored from burst to burst to determine the frequency of signals detected by the microphone and the frequency stability of the signals from burst to burst. The processing unit may be operable to identify the temporal pattern of the modulated signal by sampling the output of the demodulation arrangement. In particular, the processing unit may be operable to compare the sampled output of the demodulation arrangement with a stored reference signal. The reference signal is pre-stored. In alternative embodiments, the reference signal may be generated by exposure to a test sounding of the alarm signal. This can allow the device to learn an alarm sequence for a detector, increasing the utility of the present device. During or in response to a test exposure, the processing unit may be operable to vary the capture range of the lock-in amplifier to optimise the discrimination and speed of identification of the CO alarm signal.

The isolation device may comprise one or more user actuable input means. The user actuable input means may enable the device to be: reset, switched on, switched off, or store a reference of the alarm signal. The isolation device may be provided with indicator means. The indicator means may comprise one or more illuminable elements. The illuminable elements may be illuminated in steady or intermittent fashion to provide information on the present status of the device. In a preferred implementation, a test signal from an alarm can be identified and its status indicated without isolating the protected appliance.

The processing unit may be a microcontroller. The switch may comprise an electromechanical relay. Alternatively, the switch may be a solid state switch.

The fuel burning apparatus may be a boiler, cooker, water heater, stove or similar. The electrical supply may be a mains supply or may be from an alternative power source.

According to a second aspect of the present invention there is provided a hydrocarbon burning appliance incorporating an electrical isolation device according to the first aspect of the present invention.

The hydrocarbon burning appliance of the second aspect of the present invention incorporates all features described in relation to the first aspect of the present invention as desired or as necessary.

DETAILED DESCRIPTION OF THE INVENTION

Figure 2:
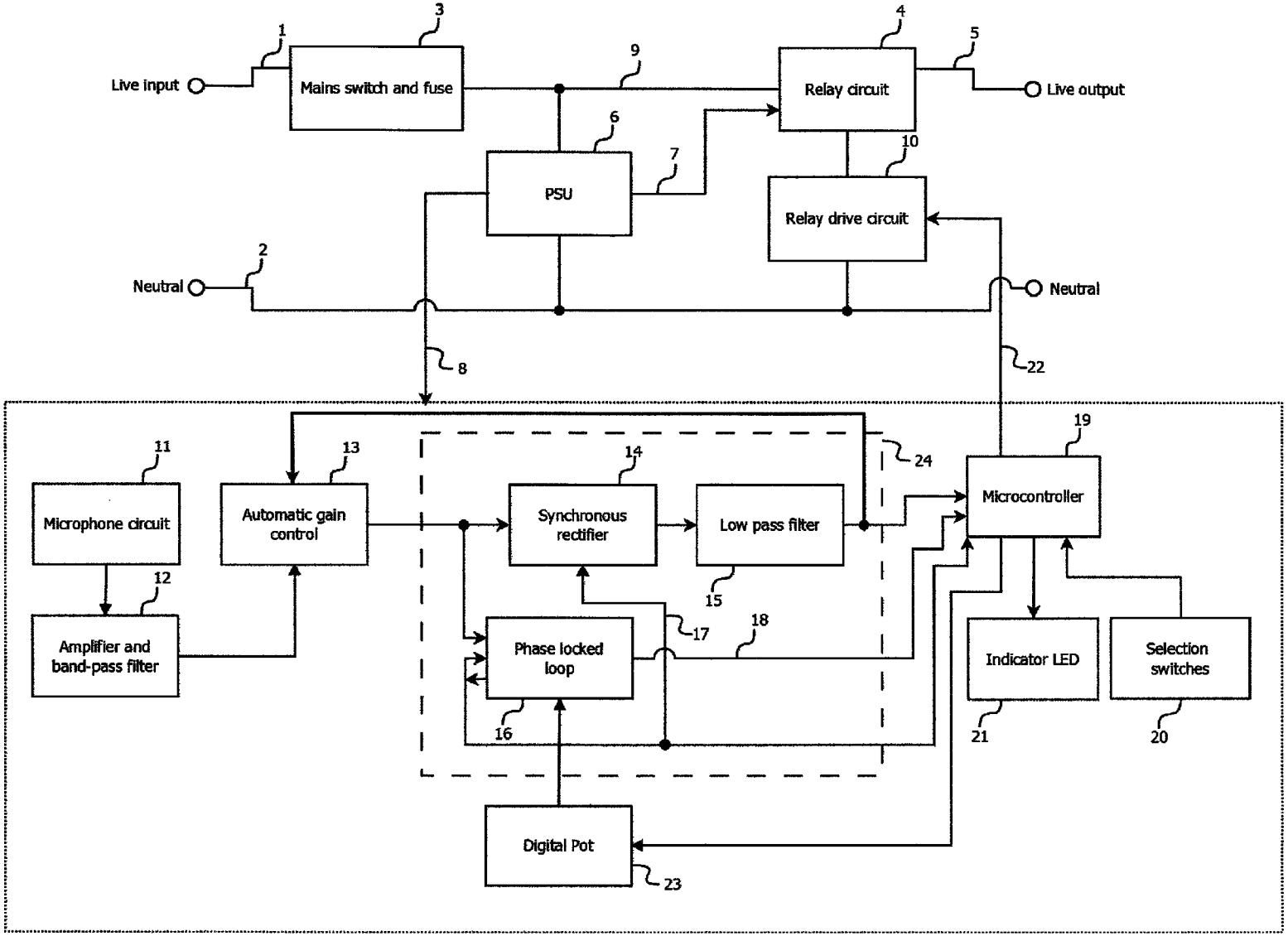

In order that the invention may be more clearly understood embodiments thereof will now be described, by way of example only, with reference to the accompanying drawings, of which:

FIG. 1 shows a block diagram of the electrical isolation device according to a first embodiment of the present invention; and FIG. 2 shows a block diagram of the electrical isolation device according to a second embodiment of the present invention.

Turning now to FIG. 1, a schematic overview of a first embodiment of an isolation device according to the present invention is shown. The device is fitted to the mains electrical supply 1, 2 for a hydrocarbon fuel burning appliance (not shown). The device is adapted to operate in response to an audible alarm signal emitted by a separately located detector (not shown), typically a carbon monoxide (CO) detector, to disconnect the electrical power supply 1, 2 and thereby shut-down the operation of the hydrocarbon fuel burning appliance. This can halt a potentially dangerous build up of CO in the vicinity of the appliance.

In FIG. 1, the live input 1 of the mains supply is connected to a fuse and manual electrical power switch 3. The switched live output 9 and mains neutral 2 is fed into a PSU circuit 6, which generates a relay supply voltage 7 together with an analogue and logic supply voltage 8. The switched live output 9 also connects to normally closed contacts of a relay circuit 4 and this provides the live output 5, together with the neutral 2, to power or isolate the hydrocarbon burning appliance. The skilled man will appreciate that the relay circuit 4 may also be arranged to switch the mains neutral 2.

Microphone circuit 11 uses an electret microphone which picks-up sound signals from an external CO detector during an alarm. The output of the microphone circuit 11 requires a high level of noise discrimination. For a typical CO detector, the alarm frequency is of the order of 3 kHz and is normally produced by a piezoelectric transducer in the CO detector. The sound frequency is normally pulsed or modulated on and off to form a particular coded sound signal. This coded signal can be different for each manufacturer of CO detector.

The output of the microphone circuit 11 is fed into an amplifier and band-pass filter 12 with a low Q, to amplify in-band signals and to ensure a good attenuation of low frequencies from subsequent stages. An automatic gain control (AGC) 13 then maintains the pass-band signal amplitude level and this output is then demodulated by a lock-in amplifier 24. The voltage setting the gain of the AGC 13 is provided by the output of the lock-in amplifier 24. Within the lock-in amplifier 24 is a PLL 16, synchronous rectifier 14 and low-pass filter 15 which recovers the envelope of the coded signal. The synchronous rectifier 14 is controlled by a local oscillator obtained from the VCO output 17 of PLL 16, which is locked to the phase of the alarm frequency. In the lock-in amplifier 24, any interfering signals with a varying phase relationship and consequently, any varying noise frequency will be highly attenuated. The low-pass filter 15 could be a simple RC filter with the time constant far greater than the period of the alarm frequency, but less than the minimum envelope period. As the bandwidth of this process is ¼ RC, even a Q approaching 1000 is achievable.

The output of AGC 13 is also fed into the phase comparator of a PLL 16, which locks its VCO to the phase of the alarm frequency. The VCO is used as a local oscillator input 17 to control the synchronous rectifier 14 and is also fed into a counter input of a microcontroller 19. When the alarm frequency bursts occurs within the capture range of the PLL 16, the PLL 16 will generate a lock signal 18 which is applied to the microcontroller 19. The microcontroller 19 then counts the VCO pulses on each burst and ensures that they remain consistent over the alarm cycle and are also within the calibrated range, in other words the frequency is stable during the alarm and also has not excessively changed from the initial calibration. Note that this allowable window of frequency drift will be smaller than the total capture frequency range of the PLL 16.

After the first lock signal is applied by the PLL 16, the microcontroller 19 then starts to sample the output of the low pass filter 15 and compares the recovered coded signal with a pre-stored copy of a particular alarm envelope signal, recorded during the installation and calibration of the safety isolation device by switching microcontroller 19 to a learn mode using selection switches 20. If the alarm signal is a close enough match to the stored copy (allowing for some variation) and it also occurs over a number of repeated cycles with the frequency criteria also met, then the microcontroller 19 will latch-off relay 4 supplying the live output 5 to the heating appliance, causing it to shut-down and stopping any further CO gas generation. The microcontroller 19 is also able to be user configured to detect alarm sequences by the use of selection switches 20, without pre-calibration.

The electrical isolation device can only be reset if the alarm has stopped, by switching the manual switch 3 off and then back-on again. This causes the PSU circuit 6 to pulse low on all its outputs and then the microcontroller 19 will reset. The microcontroller 19 will also indicate the operational status, by using an indicator LED 21. When power is available, microcontroller 19 will turn indicator LED 21 on permanently, this indicator LED 21 will also flash continuously when the alarm signal is activated and the mains power is latched-off.

Regular testing of the CO detector and electrical isolator device is possible without turning off the protected appliance. Typically, if the test button on a CO detector is pushed, it will cause a low number of cycles of the coded sound signal to be generated. The electrical isolation device can detect even a single cycle of coded sound signal and microcontroller 19 will action the indicator LED 21 to flash a corresponding short term conformation signal, but will not switch the relay 4 off, so that the mains electrical power will not be interrupted to the protected appliance. Additionally, a test mode when activated could inhibit the operation of relay 4, so that a test of the CO detector is also practical. This test mode will time-out after a short time.

Turning now to FIG. 2, there is shown an alternative embodiment of the present invention. The embodiment of FIG. 2 differs from that of FIG. 1 in the provision of digital potentiometer 23 operable in response to the microcontroller 19 to modify the performance of the lock-in amplifier 24. In the calibration process, the frequency of the alarm is measured and instead of the microcontroller 19 just setting a frequency range for a valid alarm by counting the VCO pulses and leaving the PLL 16 to have a relatively large capture range, the microcontroller 19 sets a reduced capture range for the PLL 16 centred on the measured frequency. This allows a faster lock response for a valid alarm frequency and also reduces the possibility of an in-band noise source that is not of a random nature from interfering with the noise discrimination of the lock-in amplifier 24.

The above embodiment is/embodiments are described by way of example only. Many variations are possible without departing from the scope of the invention as defined in the appended claims.

The invention claimed is:

1. An electrical isolation device for isolating the electrical supply of a fuel burning appliance in response to an audio alarm, the device comprising: a microphone circuit operable to detect audio signals; a lock-in amplifier connected to an output of the microphone circuit and operable to lock on to an alarm frequency and recover a modulated signal pattern of a potential alarm signal within the audio signals detected by the microphone circuit; a processing unit operable to monitor an output of the lock-in amplifier for valid output signals through comparison of the potential alarm signal with a stored reference to determine whether the potential alarm signal is an alarm signal and output an alarm indication in response thereto; and a switch operable in response to said alarm indication to disconnect the electrical supply of the fuel burning apparatus.

2. An electrical isolation device as claimed in claim 1 wherein the device comprises an amplifier and band pass filter to provide in-band gain to the output of the microphone circuit before input to the lock-in amplifier.

3. An electrical isolation device as claimed in claim 2 wherein an automatic gain control is provided to maintain a signal output level from the amplifier and band pass filter to the lock-in amplifier.

4. An electrical isolation device as claimed in claim 1 wherein within the lock-in amplifier an input signal is adapted to be demodulated by a demodulation arrangement.

5. An electrical isolation device as claimed in claim 4 wherein the demodulation arrangement comprises a synchronous rectifier in combination with a phase lock loop (PLL) and wherein the PLL is operable to control the polarity of the gain of the synchronous-rectifier.

6. An electrical isolation device as claimed in claim 5 wherein the synchronous rectifier is controlled in response to the voltage controlled oscillator (VCO) output of the PLL.

7. An electrical isolation device as claimed in claim 4 wherein the demodulation arrangement also comprises a low pass filter.

8. An electrical isolation device as claimed in claim 4 wherein the processing unit is used to receive the output of the demodulation arrangement.

9. An electrical isolation device as claimed in claim 6 wherein the processing unit is operable to maintain and verify a count of VCO pulses on each burst when a lock signal is also applied by the PLL.

10. An electrical isolation device as claimed in claim 9 wherein the VCO count is monitored from burst to burst to determine the frequency of signals detected by the microphone and the frequency stability of the signals from burst to burst.

11. An electrical isolation device as claimed in claim 4 wherein the processing unit is operable to identify the temporal pattern of the modulated signal by sampling the output of the demodulation arrangement.

12. An electrical isolation device as claimed in claim 11 wherein the processing unit is operable to compare the sampled output of the demodulation arrangement with a stored reference signal.

13. An electrical isolation device as claimed in claim 12 wherein the reference signal is generated by exposure to a test sounding of the alarm signal.

14. An electrical isolation device as claimed in claim 2 wherein the processing unit is operable to vary the capture range of the lock-in amplifier to optimize the discrimination and speed of identification of the alarm signal.

15. An electrical isolation device as claimed in claim 1 wherein the isolation device comprises one or more user actuable input means operable to enable the device to be: reset, switched on, switched off, or store a reference signal of the alarm signal.

16. An electrical isolation device as claimed in claim 1 wherein the isolation device is provided with indicator means operable to provide information on the present status of the device.

17. An electrical isolation device according to claim 1, in which a test signal from the alarm can be identified and the test signal's status indicated without isolating the fuel burning appliance.

18. An electrical isolation device as claimed in claim 1 wherein the processing unit is a microcontroller.

19. An electrical isolation device as claimed in claim 1 wherein the switch operable to disconnect the electrical supply comprises an electromechanical relay.

20. An electrical isolation device as claimed in claim 1 wherein the switch operable to disconnect the electrical supply is a solid state switch.

* * * * *